US009810432B2

(12) United States Patent
Biagioli et al.

(10) Patent No.: US 9,810,432 B2
(45) Date of Patent: Nov. 7, 2017

(54) METHOD FOR PREMIXING AIR WITH A GASEOUS FUEL AND BURNER ARRANGEMENT FOR CONDUCTING SAID METHOD

(71) Applicant: ALSTOM Technology Ltd, Baden (CH)

(72) Inventors: Fernando Biagioli, Fislisbach (CH); Madhavan Narasimhan Poyyapakkam, Rotkreuz (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 395 days.

(21) Appl. No.: 14/685,945

(22) Filed: Apr. 14, 2015

(65) Prior Publication Data

US 2015/0300646 A1 Oct. 22, 2015

(30) Foreign Application Priority Data

Apr. 17, 2014 (EP) ..... 14165191

(51) Int. Cl.
*F23R 3/14* (2006.01)
*F23R 3/28* (2006.01)
*F23C 7/00* (2006.01)

(52) U.S. Cl.
CPC ..... *F23R 3/14* (2013.01); *F23C 7/004* (2013.01); *F23R 3/286* (2013.01); *F23C 2900/07001* (2013.01); *F23D 2900/14021* (2013.01); *F23D 2900/14701* (2013.01)

(58) Field of Classification Search
CPC .. F23R 3/286; F23R 3/14; F23C 2900/07001; F23C 7/004; F23D 14/02; F23D 2900/14021
USPC ..... 239/399, 402, 405
See application file for complete search history.

(56) References Cited

U.S. PATENT DOCUMENTS 4,271,675 A * 6/1981 Jones ..... F23R 3/14 239/406
5,943,866 A * 8/1999 Lovett ..... F23R 3/286 431/114
6,141,967 A 11/2000 Angel et al.
6,438,961 B2 8/2002 Tuthill et al.
(Continued)

FOREIGN PATENT DOCUMENTS

EP 0 935 097 A2 8/1999
EP 0 936 406 A2 8/1999
(Continued)

*Primary Examiner* — Pascal M Bui Pho
*Assistant Examiner* — Stefan Ibroni
(74) *Attorney, Agent, or Firm* — Buchanan Ingersoll & Rooney PC

(57) ABSTRACT

A method for premixing air with a gaseous fuel for being burned in a combustion chamber includes:

guiding the air in an air stream along a burner axis through a coaxial air tube into a combustion chamber arranged at an end of said air tube; and impressing a swirl on the air stream by passing it through a first swirl device concentrically arranged within the air tube and comprising a plurality of radially oriented first blades. The method further includes:

injecting gaseous fuel into the air stream at the first swirl device; and mixing said air in said air stream with the injected gaseous fuel in a first mixing zone arranged just after said first swirl device.

29 Claims, 4 Drawing Sheets

(56) References Cited

U.S. PATENT DOCUMENTS

| | | | | |
|---|---|---|---|---|
| 6,594,999 | B2 * | 7/2003 | Mandai | F23R 3/14 60/722 |
| 7,137,258 | B2 | 11/2006 | Widener | |
| 7,578,130 | B1 | 8/2009 | Kraemer et al. | |
| 7,673,454 | B2 * | 3/2010 | Saito | F02C 3/14 60/737 |
| 7,836,698 | B2 * | 11/2010 | Vandale | F23D 14/62 60/737 |
| 8,850,821 | B2 * | 10/2014 | Khan | F23R 3/14 60/737 |
| 9,395,084 | B2 * | 7/2016 | Bobba | F23R 3/14 |
| 2006/0236700 | A1 * | 10/2006 | Saitoh | F23R 3/14 60/737 |
| 2007/0089426 | A1 | 4/2007 | Vandale et al. | |
| 2009/0056336 | A1 | 3/2009 | Chila et al. | |
| 2010/0293956 | A1 | 11/2010 | Nadkarni | |
| 2013/0133329 | A1 * | 5/2013 | Wang | F23R 3/286 60/737 |
| 2013/0167541 | A1 * | 7/2013 | Bathina | F23R 3/14 60/738 |

FOREIGN PATENT DOCUMENTS

| | | | |
|---|---|---|---|
| EP | 2 511 607 | A2 | 10/2012 |
| EP | 2 613 086 | A2 | 7/2013 |
| EP | 2 672 183 | A2 | 12/2013 |
| EP | 2 685 164 | A1 | 1/2014 |
| JP | 2005180799 | A | 7/2005 |

* cited by examiner

METHOD FOR PREMIXING AIR WITH A GASEOUS FUEL AND BURNER ARRANGEMENT FOR CONDUCTING SAID METHOD

CROSS-REFERENCE TO RELATED APPLICATIONS

This application claims priority to European application 14165191.9 filed Apr. 17, 2014, the contents of which are hereby incorporated in its entirety.

TECHNICAL FIELD

The present invention relates to combustion technology, especially for gas turbines. It refers to a method for premixing air with a gaseous fuel for being burned in a combustion chamber according to the preamble of claim 1. It further relates to a burner arrangement for conducting such a method.

BACKGROUND

Swirl burners are devices that, by giving sufficiently strong swirl to an air flow, lead to the formation of a central reverse flow region (Central Recirculation Zone CRZ, vortex breakdown mechanism), which can be used for the stabilization of flames in gas turbine combustors.

Targeting best fuel-air premixing and low pressure drop is often a challenge.

Good fuel/air premixing must be in fact achieved in a mixing region before the CRZ where the flame is stabilized. This implies sufficiently high pressure losses in this region, i.e. the use of a swirler with high swirl number, allowing for high velocity tangential shearing in the fuel-air mixing section before vortex breakdown takes place.

High swirl number flows however give origin to excessive shearing at CRZ with significant increase of pressure losses just in this region. These pressure loss characteristics are shown in FIG. 1 from the Large Eddy Simulation of two different axial swirl burner arrangements with swirl numbers of 0.7 and 0.56. The burner arrangement 20 of FIG. 1(*b*) comprises an air tube 21 extending along burner axis 23 and opening at one end into combustion chamber 22. A central cylindrical bluff body 27 arranged concentrically within air tube 21 defines an annular channel for air and air/fuel flow to combustion chamber 22, resulting in central recirculation zone 26. Fuel is introduced into the air stream at a concentric swirl device 24 and mixed with the air in a subsequent mixing section 25.

The high swirl number variant (open squares in FIG. 1(*a*)) is characterized by a non-dimensional pressure loss Dp (measured in units given by the dynamic head in terms the bulk flow velocity in the mixing section) in the mixing section of approx. 2. This can ensure good fuel/air premixing but a rather large and not necessary pressure loss of approx. 8 at the CRZ.

The low swirl number variant (filled triangles in FIG. 1(*a*)) gives instead a pressure loss of approx. 0.7 in the mixing section which is not effective for fuel-air premixing and acceptable pressure drop of approx. 5.5 around the CRZ.

Thus, good air/fuel premixing and low pressure loss at the beginning of the CRZ is difficult to be put into practice at the same time with a single swirl device.

Document U.S. Pat. No. 6,438,961 B2 discloses a burner for use in a combustion system of a heavy-duty industrial gas turbine, which includes a fuel/air premixer having an air inlet, a fuel inlet, and an annular mixing passage. The fuel/air premixer mixes fuel and air into a uniform mixture for injection into a combustor reaction zone. The burner also includes an inlet flow conditioner disposed at the air inlet of the fuel/air premixer for controlling a radial and circumferential distribution of incoming air. The pattern of perforations in the inlet flow conditioner is designed such that a uniform air flow distribution is produced at the swirler inlet annulus in both the radial and circumference directions. The premixer includes a swozzle assembly having a series of preferably air foil shaped turning vanes that impart swirl to the airflow entering via the inlet flow conditioner. Each air foil contains internal fuel flow passages that introduce natural gas fuel into the air stream via fuel metering holes that pass through the walls of the air foil shaped turning vanes. By injecting fuel in this manner, an aerodynamically clean flow field is maintained throughout the premixer. By injecting fuel via two separate passages, the fuel/air mixture strength distribution can be controlled in the radial direction to obtain optimum radial concentration profiles for control of emissions, lean blow outs, and combustion driven dynamic pressure activity as machine and combustor load are varied.

Document US 2009/056336 A1 discloses a burner for use in a combustion system of an industrial gas turbine. The burner includes a fuel/air premixer including a splitter vane defining a first, radially inner passage and a second, radially outer passage, the first and second passages each having air flow turning vane portions which impart swirl to the combustion air passing through the premixer. The vane portions in each passage are commonly configured to impart a same swirl direction in each passage. A plurality of splitter vanes may be provided to define three or more annular passages in the premixer.

Document US 2010/293956 A discloses fuel nozzle auxiliary vane comprising a vane mountable base comprising a fuel inlet, wherein the vane mountable base is configured to mount to a surface of a main vane disposed in an airflow path of a fuel nozzle. The fuel nozzle auxiliary vane also includes a body extending from the vane mountable base, wherein the body comprises a fuel passage that turns from the fuel inlet to a fuel outlet, and the fuel outlet has a fuel outlet direction generally crosswise to a fuel inlet direction through the fuel inlet.

Document U.S. Pat. No. 7,137,258 B2 discloses a combustor including a center nozzle surrounded by a plurality of outer nozzles, the center nozzle and each of the outer nozzles having a fuel passage and an air passage, with a swirler surrounding the fuel passage and having a plurality of vanes projecting radially within the air passage, each vane having a trailing edge arranged at a swirl angle relative to a longitudinal axis of the nozzle, wherein the swirl angle for the swirler in the center nozzle is different than the swirl angle for the swirlers in the plurality of outer nozzles.

Document U.S. Pat. No. 7,578,130 B1 discloses methods and systems for combustion dynamics reduction. A combustion chamber may include a first premixer and a second premixer. Each premixer may include at least one fuel injector, at least one air inlet duct, and at least one vane pack for at least partially mixing the air from the air inlet duct or ducts and fuel from the fuel injector or injectors. Each vane pack may include a plurality of fuel orifices through which at least a portion of the fuel and at least a portion of the air may pass. The vane pack or packs of the first premixer may be positioned at a first axial position and the vane pack or packs of the second premixer may be positioned at a second axial position axially staggered with respect to the first axial position.

Document EP 2 685 164 A1 discloses an axial swirler for a gas turbine burner comprising a vane ring with a plurality of swirler vanes circumferentially distributed around a swirler axis, each of said swirler vanes comprising a trailing edge in order to achieve a controlled distribution of the exit flow velocity profile and/or the fuel equivalence ratio in the radial direction, said trailing edge being discontinuous with the trailing edge having a discontinuity at a predetermined radius.

Usually only one swirler is used for vortex breakdown and mixing. This is not optimal because good fuel/air premixing requires high swirl but this gives origin to too high pressure drop around the CRZ.

SUMMARY

It is an object of the present invention to provide a premixing method and burner arrangement, which avoid the disadvantages of known methods and devices and:

- achieve low pressure drop and, at the same time, ensure best fuel/air premixing;
- give the possibility of different discharge flow radial velocity distributions;
- spread convective time lags from fuel injection to flame for control of thermoacoustic instabilities; and
- allow fuel staging.

This and other objects are obtained by a method according to claim 1 and burner arrangement according to claim 15.

The method according to the invention for premixing air with a gaseous fuel for being burned in a combustion chamber comprises the steps of:

- guiding said air in an air stream along a burner axis through a coaxial air tube into a combustion chamber arranged at an end of said air tube;
- impressing a swirl on said air stream by passing it through a first swirl device concentrically arranged within said air tube and comprising a plurality of radially oriented first blades;
- injecting gaseous fuel into said air stream at said first swirl device; and mixing said air in said air stream with the injected gaseous fuel in a first mixing zone arranged just after said first swirl device.

It is characterized in that it further comprises the steps of:

- sending the mixed fuel/air stream leaving said first mixing zone through at least one second swirl device concentrically arranged within said air tube and comprising a plurality of radially oriented second blades to reduce the swirl of the mixed fuel/air stream;
- injecting gaseous fuel into said mixed fuel/air stream at said second swirl device; and
- further mixing said mixed fuel/air stream with the injected gaseous fuel in a second mixing zone arranged just between said second swirl device and said combustion chamber.

According to an embodiment of the inventive method the gaseous fuel is injected at said first and second swirl device by means of gas holes provided on the suction sides and/or pressure sides of said first and second blades.

Especially, said gas holes are arranged in rows oriented perpendicular to the burner axis.

According to another embodiment of the inventive method said first swirl device has a first swirl number, said second swirl device has a second swirl number, and said second swirl number is smaller than said first swirl number.

According to a further embodiment of the inventive method each of said first and second swirl devices has a number of blades between 6 and 10.

According to another embodiment of the inventive method the cylindrical cross section of the blades of the first and second swirl device has the shape of an airfoil in order to reduce a pressure drop.

Especially, each of the blades of the first and second swirl device has a leading edge and a trailing edge, whereby the leading edge of the blades of the second swirl device is aligned in terms of inflow angle with outflow angle of the trailing edge of the blades of the first swirl device.

When there are more than two swirl devices arranged in a series along the burner axis, the leading edge of the blades of the following swirl device is aligned in terms of inflow angle with outflow angle of the trailing edge of the blades of the foregoing swirl device.

Specifically, said airfoils of said swirl devices are designed to produce a certain exit flow angle $\alpha$ of the air/fuel flow, whereby said exit flow angle $\alpha$ has a predetermined dependence $\alpha(r)$ of the radius r with respect to the burner axis.

More specifically, $\tan \alpha(r)=H \cdot r+K$ with constants H and K.

Alternatively, $\tan \alpha(r)$ is proportional to $1/r$.

Alternatively, $\tan \alpha(r)=\text{const}$.

According to just another embodiment of the inventive method the air is guided through a cylindrical coaxial air tube having an inner air tube radius, in an annular space between said coaxial air tube and a concentric central bluff body having an outer bluff body radius, whereby the ratio between said outer bluff body radius and said inner air tube radius is between 0.3 and 0.8.

According to another embodiment of the inventive method the fuel is supplied to the blades of the first and second swirl device via respective cavities within said blades by means of a fuel distribution system, which allows to control the fuel supply to each swirl device, each blade within said swirl device, and each of said suction and pressure sides of the blade, and combustion instabilities within said combustion chamber are controlled by means of said fuel distribution system via fuel staging between different swirl devices and/or different sides of the blades.

According to a further embodiment of the inventive method said first and second swirl devices have an outer radius R and said first mixing zone has an axial length L, and said ratio L/R is between 0.5 and 4.

The inventive burner arrangement for conducting a method according to the invention comprises an air tube extending along a burner axis and opening at one end into a combustion chamber, a first coaxial swirl device arranged concentrically within said air tube at a first distance from said combustion chamber, said first swirl device comprising a plurality of radially oriented first blades and first means for injecting fuel into an air stream passing said first swirl device.

It is characterized in that at least one second swirl device is arranged within said air tube downstream of said first swirl device, thereby defining a first mixing section between said first and second swirl device, whereby said second swirl device comprises a plurality of radially oriented second blades and second means for injecting fuel into a fuel/air stream passing said second swirl device.

An embodiment of the inventive burner arrangement is characterized in that said second swirl device is arranged at a second distance from said combustion chamber, thereby defining a second mixing section.

Another embodiment of the inventive burner arrangement is characterized in that said first and second fuel injection means comprises a plurality of gas holes provided on the suction sides and/or pressure sides of said first and second blades.

Specifically, said gas holes are arranged in rows oriented perpendicular to the burner axis.

A further embodiment of the inventive burner arrangement is characterized in that said first swirl device has a first swirl number, said second swirl device has a second swirl number, and said second swirl number is smaller than said first swirl number.

Another embodiment of the inventive burner arrangement is characterized in that each of said first and second swirl devices has a number of blades between 6 and 10.

Just another embodiment of the inventive burner arrangement is characterized in that the cylindrical cross section of the blades of the first and second swirl device has the shape of an airfoil.

Specifically, each of the blades of the first and second swirl device has a leading edge and a trailing edge, whereby the leading edge of the blades of the second swirl device is aligned in terms of inflow angle with outflow angle of the trailing edge of the blades of the first swirl device.

When there are more than two swirl devices arranged in a series along the burner axis, the leading edge of the blades of the following swirl device is aligned in terms of inflow angle with outflow angle of the trailing edge of the blades of the foregoing swirl device.

Another embodiment of the inventive burner arrangement is characterized in that said airfoils of said swirl devices are designed to produce a certain exit flow angle $\alpha$ of the air/fuel flow, whereby said exit flow angle $\alpha$ has a predetermined dependence $\alpha(r)$ of the radius r with respect to the burner axis).

Specifically, $\tan \alpha(r)=H \cdot r+K$ with constants H and K.

Alternatively, $\tan \alpha(r)$ is proportional to $1/r$.

Alternatively, $\tan \alpha(r)=\text{const}$.

Another embodiment of the inventive burner arrangement is characterized in that the air tube is cylindrical in shape having an inner air tube radius, that a concentric central bluff body is arranged within said air tube having an outer bluff body radius, and that the ratio between said outer bluff body radius and said inner air tube radius is between 0.3 and 0.8.

A further embodiment of the inventive burner arrangement is characterized in that the fuel is supplied to the blades of the first and second swirl device via respective cavities within said blades by means of a fuel distribution system, which allows to control the fuel supply to each swirl device, each blade within said swirl device, and each of said suction and pressure sides of the blade.

Another embodiment of the inventive burner arrangement is characterized in that said first and second swirl devices have an outer radius R and said first mixing zone has an axial length L, and said ratio L/R is between 0.5 and 4.

BRIEF DESCRIPTION OF THE DRAWINGS

The present invention is now to be explained more closely by means of different embodiments and with reference to the attached drawings.

DETAILED DESCRIPTION

The basic idea of the present invention relates to a series of two axial swirl burners or devices, the first swirl device with high swirl for optimization of fuel/air mixing and the second swirl device with low swirl for low pressure drop at the Central Recirculation Zone (CRZ).

Figure 1:
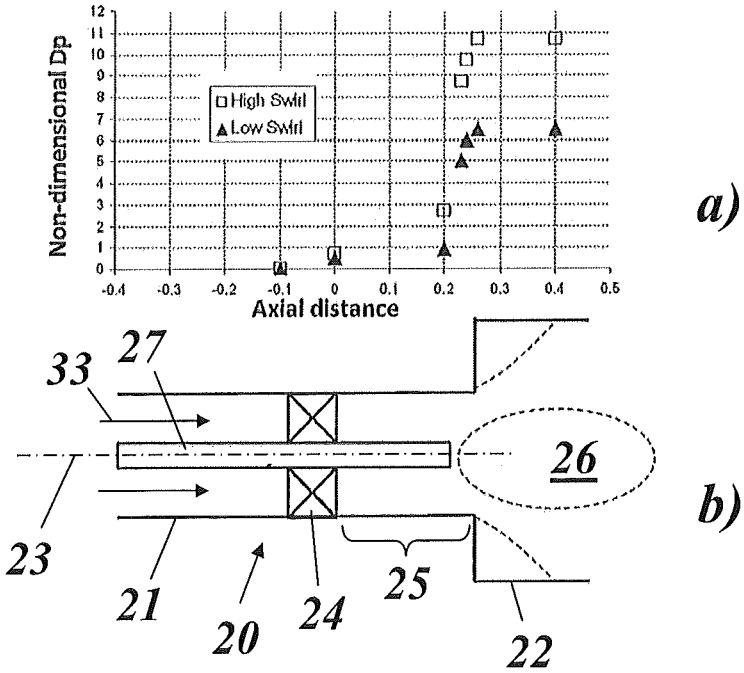
FIG. 1 shows a known burner arrangement with one swirl device (b) and a diagram of the non-dimensional pressure drop along the axis of said burner arrangement for two different swirl devices with different swirl numbers (a)

Thus, the invention disclosed here comprises a swirl/mixing arrangement realized with a given number of two or more axial swirl devices arranged sequentially along a burner axis. Fuel is injected from cavities obtained in the swirler blades. The pressure loss characteristic in case of two sequential swirl devices is shown in a figure similar to FIG. 1 in FIG. 2.

Figure 2:
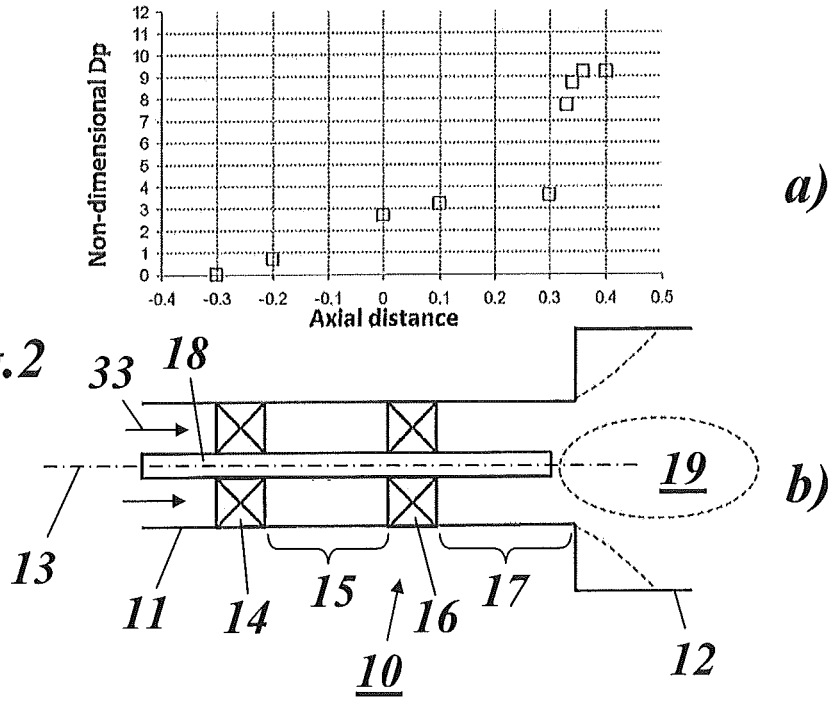
FIG. 2 shows a burner arrangement according to an embodiment of the invention with two subsequent swirl devices of different swirl number (b) and the resulting non-dimensional pressure drop along the axis of said burner arrangement (a)

The burner arrangement 10 of FIG. 2 comprises an air tube 11 extending along a burner axis 13 and opening at the downstream end into a combustion chamber 12, where a Central Recirculation Zone (CRZ) 19 is established during operation of the burner. A central, cylindrical and coaxial bluff body 18 within air tube 11 defines an annular channel for air and air/fuel flow towards combustion chamber 12. Two concentric swirl devices 14 and 16 are provided in series in the annular channel, thereby defining a first mixing section 15 between the two swirl devices 14, 16, and a second mixing section 17 between the second swirl device 16 and the entrance of combustion chamber 12. At both swirl devices 14 and 16, gaseous fuel is injected into the passing air stream.

As can be seen from the diagram in FIG. 2(*a*), these characteristics (high swirl in swirl device 14; low swirl in swirl device 16) allow for very good premixing of the portion of fuel injected from the first swirl device 14, with the second swirl device 16 working as a de-swirl device, allowing for low pressure drop around the CRZ 19.

A second important advantage of this arrangement is the spread of convective time lags of fuel to the flame with positive impact on combustion dynamics.

In more detail, each swirl device comprises a given number of radially extended blades with cross section at a given radius having an airfoil shape. Fuel is injected from holes drilled on the suction and/or pressure sides of each swirler blade. The design allows to optimize mixing and pressure drop and, at the same time, gives flexibility on the control of time lags between fuel injection and flame.

Figure 3:
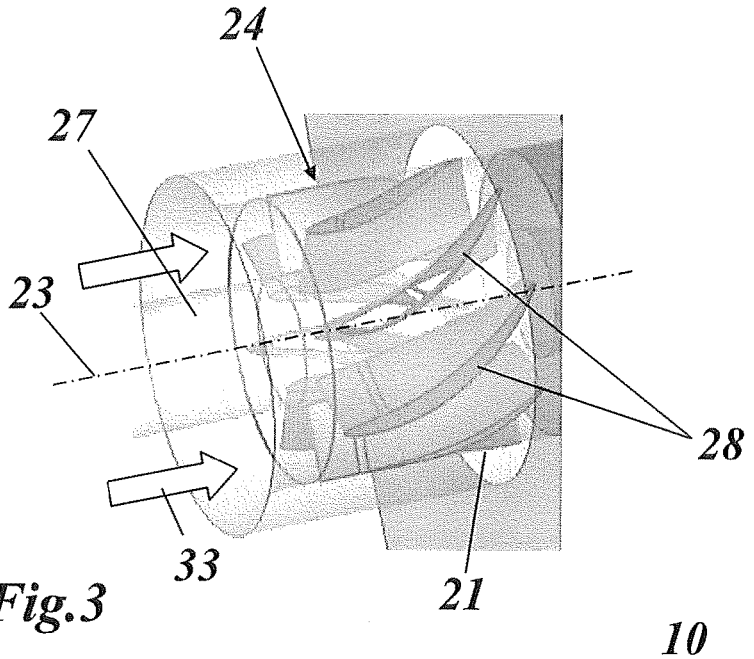
FIG. 3 shows a 3-dimensional drawing of the configuration of an exemplary swirl device with a plurality of radial airfoil blades, which can be used in the present invention.

Thus, the basic component of the present invention is a swirl device 24, as shown in FIG. 3, which comprises a series of radial blades 28 arranged circumferentially around a cylindrical bluff body 27, which blades 28 are designed to impart a swirl component to an air flow entering along burner axis 23 into air tube 21 of the mentioned device. The device can be designed in order to target any possible radial distribution of axial and tangential velocities, for example satisfying the inviscid conservation equations of total pressure and radial momentum and a specific radial distribution of exit flow angle $\alpha$. The invention applies to any function describing the radial distribution of swirler exit flow angle $\alpha$.

Figure 4:
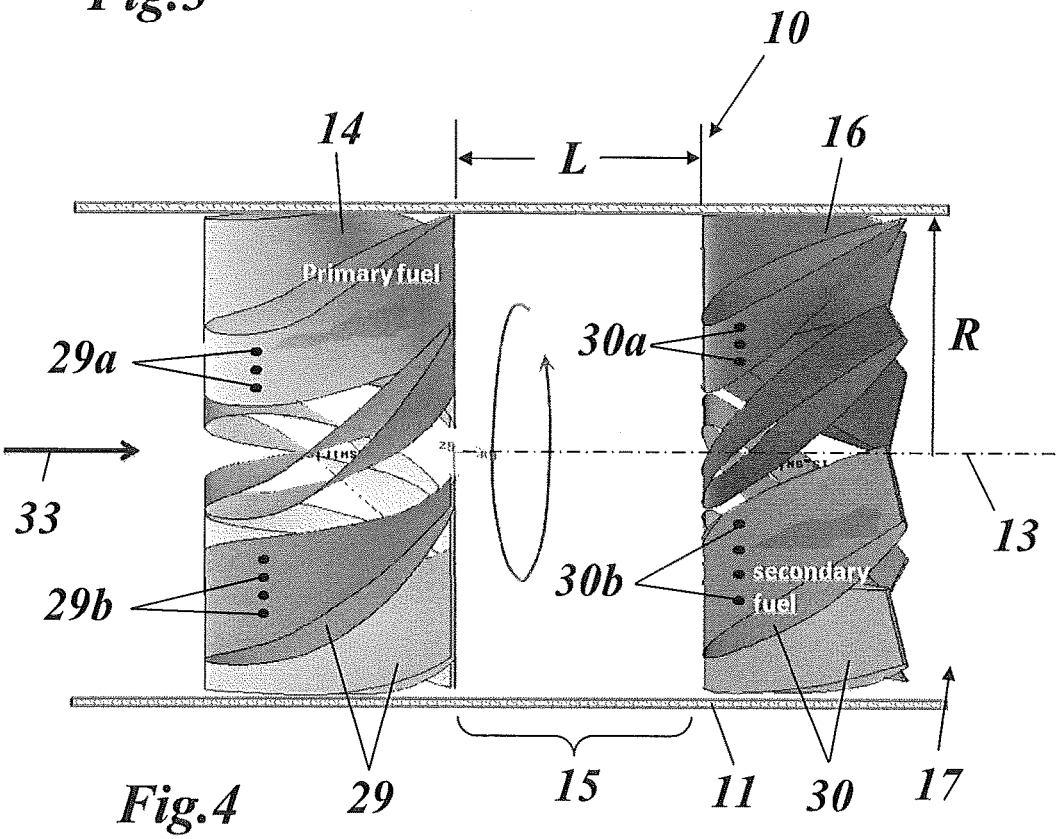
FIG. 4 shows a sectional view of a burner arrangement according to another embodiment of the invention with two swirl devices having fuel injection means at the pressure and suction sides of their airfoil blades.

The burner arrangement 10 according to the present invention (see FIG. 4) comprises at least two swirl devices 14 and 16 arranged sequentially in the flow direction with a mixing section 15 in between. The first swirl device 14 is characterized by high swirl number while the second swirl device 16 is characterized by low swirl number. Fuel is injected in the stream of air 33 flowing through the two swirl devices 14 and 16 from gas holes 29*a,b* and 30*a,b* placed on the suction and/or pressure sides of the swirler blades 29 and 30. Fuel is distributed via cavities obtained within the swirler blades 29, 30 and connected to an external fuel distribution ring organized around the swirl devices (see FIG. 6).

The first swirl device 14 imparts a high swirl to the air stream which helps to obtain good fuel/air mixing in the mixing section 15 (of axial length L) placed between the two swirl devices 14 and 16. The main scope of the second swirl device 16 is instead to reduce the swirl number (de-swirl function) before vortex breakdown takes place. The second swirl device 16 is used also to inject a portion of the fuel in order to have a spread of fuel time lags to the flame which helps on the side of flame dynamics.

Possible radial distributions of axial and tangential velocities of the swirler are obtained from three types of radial distribution of blade exit flow angle $\alpha(r)$:

A) whose tangent is linearly increasing in the radial direction, i.e. such that $\tan \alpha(r)=W/U=H\cdot r+K$ with H and K constants and W, U tangential and axial velocities;

B) with $\tan \alpha(r)=W/U=\text{const.}$; and

C) with $\tan \alpha(r)=W/U$ proportional to 1/r (implying irrotational flow and U=const).

Hybrid combinations of these distributions are also possible, e.g. linear increase up to an intermediate radius, i.e. distribution A) and decrease above it, i.e. distribution B).

Each distribution is characterized by a swirl number which is determined by the distribution itself and the values of exit flow angle at minimum (hub) and maximum (tip) radiuses of the blade.

Figure 5:
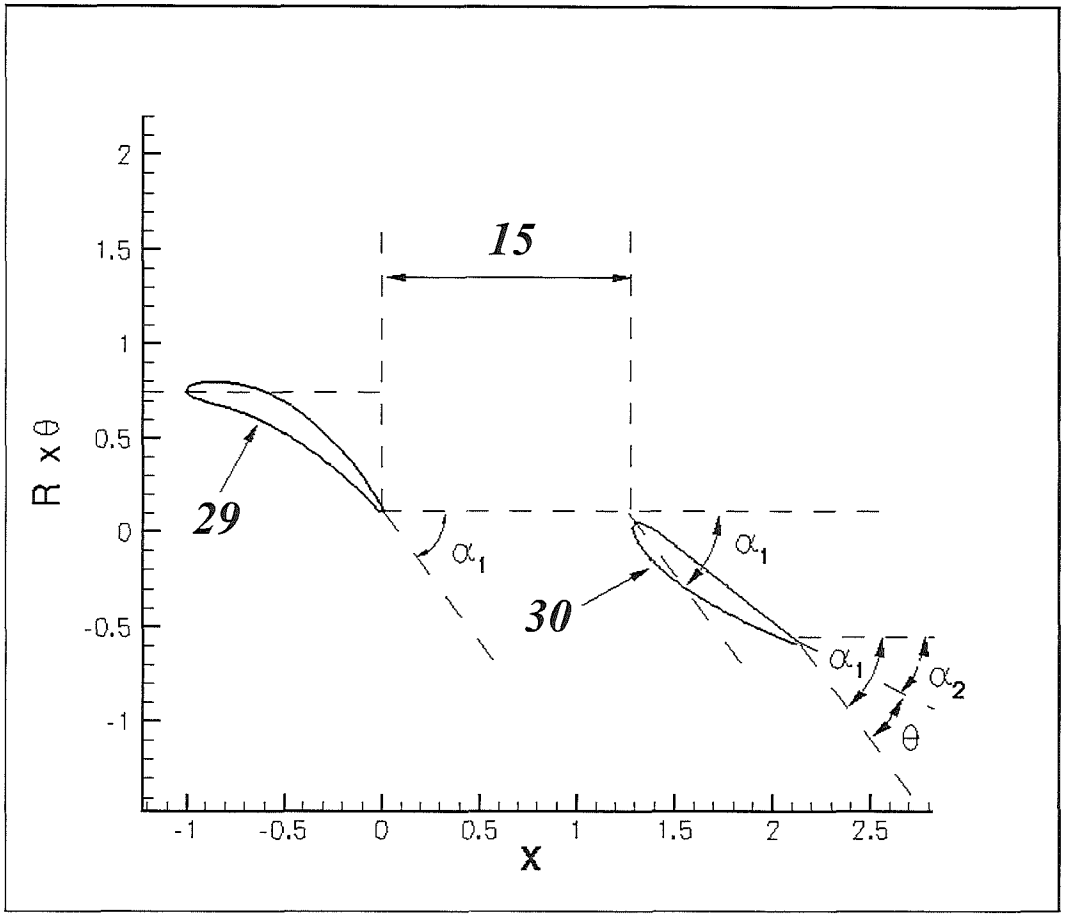
FIG. 5 shows a more detailed schematics of the alignment between the blades of the first and second swirl devices.

FIG. 5 shows a more detailed schematic of a radial cross section of the invention (only one blade/swirl device is shown). The leading edge of the high swirl device (blade 29) is aligned with the main flow axis. The airfoil is designed in order to produce an exit flow angle $\alpha_1=50°$. The second swirl device (blade 30) must be able to produce a reduction in exit flow angle. For this reason the second swirl device is designed counter-swirling to the first one.

In order to avoid flow separation, the camber line of the second swirl device (blade 30) is aligned at the leading edge with the camber line of the first swirl device (blade 29) at the trailing swirler edge. This angle is therefore reduced through the extent of the second swirl device by a rotation of the flow $\theta$ given by $\alpha_1$-$\alpha_2$ with $\alpha_2$ being the exit flow angle desired before vortex breakdown.

Figure 6:
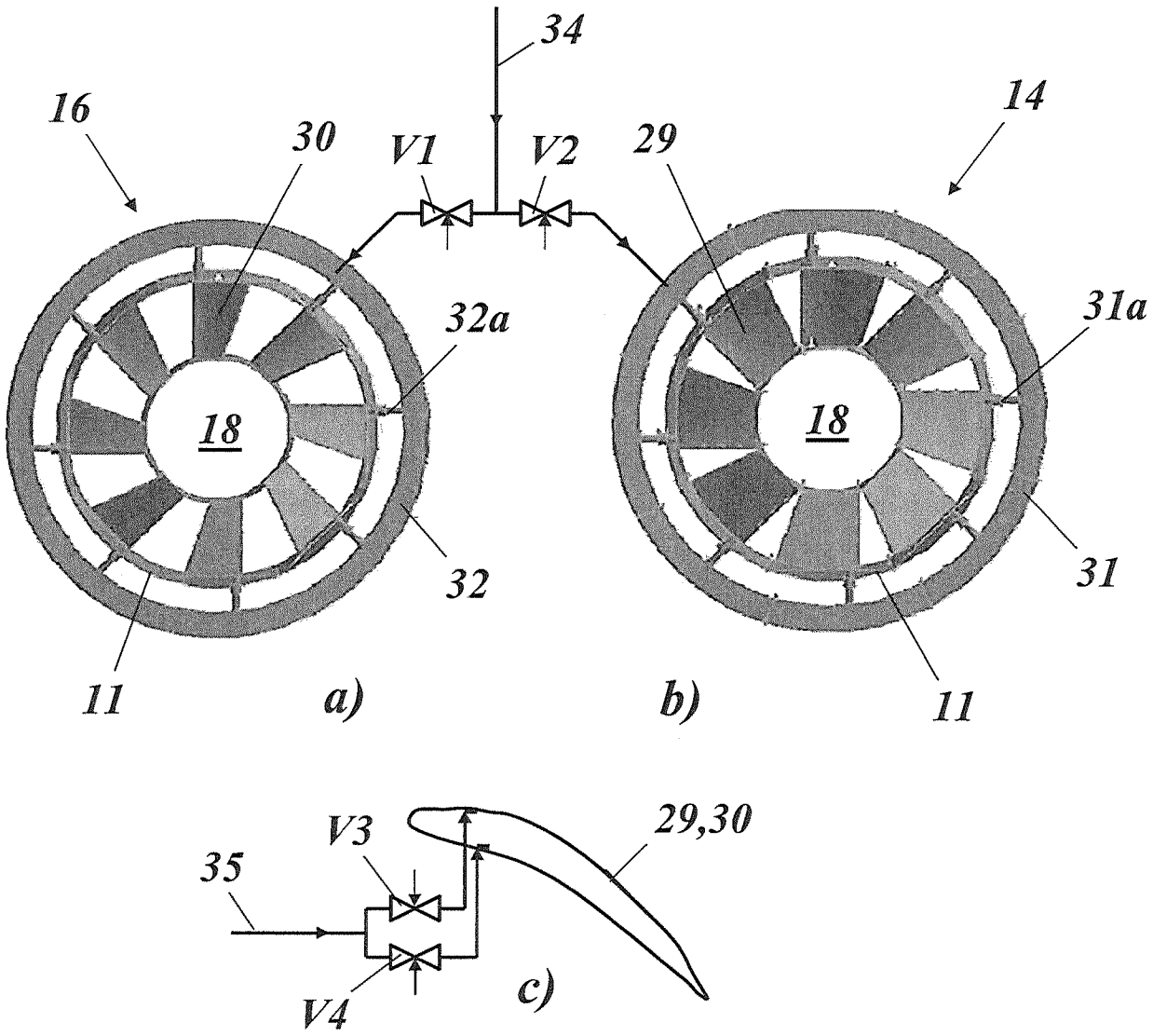
FIG. 6 shows axial views of the first and second swirl devices with a respective fuel distribution system (a and b), and the schematics of the fuel distribution within each airfoil (c).

The present invention includes also a fuel distribution system (FIG. 6) characterized by one external fuel distribution ring 31 and 32 which distributes fuel via fuel supply lines 31*a*, 32*a* to cavities obtained inside the swirler blades 29, 30. This fuel is injected into the air stream from gas holes 29*a,b* and 30*a,b* drilled on the suction and/or pressure side of the blades (see FIG. 4). The fuel supply to the swirl devices 14 and 16 via fuel supply line 34 can be independently controlled by valves V1 and V2 (FIGS. 6*a* and *b*).

The possibility of staging fuel between suction and pressure side (independent feed of fuel to suction and pressure sides) is also included in this invention. Therefore, the fuel supply to the gas holes of the suction and pressure side of the blades via fuel supply line 35 can be independently controlled by valves V3 and V4 (FIG. 6*c*).

In summary, the invention covers a burner arrangement capable of imparting swirl to an air stream and injecting fuel which premixes with the air stream.

In detail, there are the following characteristic features:

- The arrangement comprises a sequence of minimum 2 and maximum 4 axial swirl devices with different swirl numbers for optimal pressure drop, fuel air premixing and combustion dynamics;
- The number of swirler blades for each swirl device is between 6 and 10 to allow control of fuel air premixing and homogenization of discharge flow;
- The ratio between minimum and maximum radius of the swirl devices is between 0.25 and 0.5;
- The swirl number of each single swirl device is between 0.3 and 0.8
- The cylindrical cross section of the blades is shaped like an airfoil for reduction of pressure drop;
- A fuel/air mixing section is provided between two consecutive swirl devices with axial extension L with ratio L/R between 0.5 and 4 (with R external radius of the swirl devices).
- There are several distributions of exit flow angle possible, i.e. $\tan \alpha(r)=W/U=H\cdot r+K$, $\tan \alpha(r)=W/U=\text{const.}$, and $\tan \alpha(r)=W/U$ proportional to 1/r;
- Leading edge of blades of each swirl device is aligned in terms of inflow angle with outflow angle of trailing edge of upstream swirl device;
- A fuel distribution system is given by an external ring pipe capable of feeding the fuel to the blades via cavities. The possibility of staging fuel between suction and pressure sides and between several swirl devices is advantageous;
- A method can be used to control combustion instabilities via staging fuel between different stages (pressure-suction sides, between different swirl devices);

The advantage(s) of the present invention is:

It allows to explore a totally new burner concept with potential of good fuel/air premixing and low pressure drop. The spread of convective time lags between fuel and flame is a promising solution for reducing the amplitude of the flame dynamic response (Flame Transfer Function).

The invention claimed is:

1. A method for premixing air with a gaseous fuel for being burned in a combustion chamber, said method comprising:

- guiding said air in an air stream along a burner axis through a coaxial air tube into a combustion chamber arranged at an end of said air tube;
- impressing a swirl on said air stream by passing it through a first swirl device concentrically arranged within said air tube and comprising a plurality of radially oriented first blades;
- injecting gaseous fuel into said air stream at said first swirl device; and
- mixing said air in said air stream with the injected gaseous fuel in a first mixing zone arranged just after said first swirl device;

sending the mixed fuel/air stream leaving said first mixing zone through a second swirl device concentrically arranged within said air tube and comprising a plurality of radially oriented second blades to reduce the swirl of the mixed fuel/air stream;

wherein the camber line of a blade of the second blades is aligned at a leading edge of the blade of the second blades with the camber line of a blade of the first blades at a trailing edge of the blade of the first blades to avoid flow separation, injecting gaseous fuel into said mixed fuel/air stream at said second swirl device; and further mixing said mixed fuel/air stream with the injected gaseous fuel in a second mixing zone arranged just between said second swirl device and said combustion chamber.

2. The method as claimed in claim 1, wherein the gaseous fuel is injected at said first and second swirl device by means of gas holes provided on the suction sides and/or pressure sides of said first and second blades.

3. The method as claimed in claim 2, wherein said gas holes are arranged in rows oriented perpendicular to the burner axis.

4. The method as claimed in claim 1, wherein said first swirl device has a first swirl number, said second swirl device has a second swirl number, and said second swirl number is smaller than said first swirl number.

5. The method as claimed in claim 1, wherein each of said first and second swirl devices has a number of first and second blades between 6 and 10, respectively.

6. The method as claimed in claim 1, wherein the cylindrical cross section of the blades of the first and second swirl device has the shape of an airfoil in order to reduce a pressure drop.

7. The method as claimed in claim 6, wherein each of the blades of the first and second swirl device has a leading edge and a trailing edge, whereby the leading edge of the blades of the second swirl device is aligned in terms of inflow angle with outflow angle of the trailing edge of the blades of the first swirl device.

8. The method as claimed in claim 6, wherein said airfoils of said swirl devices are designed to produce a certain exit flow angle $\alpha$ of the air/fuel flow, whereby said exit flow angle $\alpha$ has a predetermined dependence $\alpha(r)$ of the radius r with respect to the burner axis.

9. The method as claimed in claim 7, wherein $\tan \alpha(r) = H \cdot r + K$ with constants H and K.

10. The method as claimed in claim 7, wherein $\tan \alpha(r)$ is proportional to 1/r.

11. The method as claimed in claim 7, wherein $\tan \alpha(r) = \text{const}$.

12. The method as claimed in claim 1, wherein the air is guided through the cylindrical coaxial air tube having an inner air tube radius, in an annular space between said coaxial air tube and a concentric central bluff body having an outer bluff body radius, whereby the ratio between said outer bluff body radius and said inner air tube radius is between 0.3 and 0.8.

13. The method as claimed in claim 2, wherein the fuel is supplied to the blades of the first and second swirl device via respective cavities within said first and second blades by means of a fuel distribution system, which allows to control the fuel supply to each swirl device, each blade within said first and second swirl device, and each of said suction and pressure sides of each blade of the first and second blades, and that combustion instabilities within said combustion chamber are controlled by means of said fuel distribution system via fuel staging between the first and second swirl devices and/or different sides of each blade of the first and second blades.

14. The method as claimed in claim 1, wherein said first and second swirl devices have an outer radius R and said first mixing zone has an axial length L, and said ratio L/R is between 0.5 and 4.

15. A burner arrangement for conducting a method according to claim 1, comprising an air tube extending along a burner axis and opening at one end into a combustion chamber, a first coaxial swirl device arranged concentrically within said air tube at a first distance from said combustion chamber, said first swirl device comprising a plurality of radially oriented first blades and first means for injecting fuel into an air stream passing said first swirl device, characterized in that a second swirl device is arranged within said air tube downstream of said first swirl device, thereby defining a first mixing section between said first and second swirl device, whereby said second swirl device comprises a plurality of radially oriented second blades and second means for injecting fuel into a fuel/air stream passing said second swirl device.

16. The burner arrangement as claimed in claim 15, wherein said second swirl device is arranged at a second distance from said combustion chamber, thereby defining a second mixing section.

17. The burner arrangement as claimed in claim 15, wherein said first and second fuel injection means comprises a plurality of gas holes provided on the suction sides and/or pressure sides of said first and second blades.

18. The burner arrangement as claimed in claim 17, wherein said gas holes are arranged in rows oriented perpendicular to the burner axis.

19. The burner arrangement as claimed in claim 15, wherein said first swirl device has a first swirl number, said second swirl device has a second swirl number, and said second swirl number is smaller than said first swirl number.

20. The burner arrangement as claimed in claim 15, wherein each of said first and second swirl devices has a number of blades between 6 and 10.

21. The burner arrangement as claimed in claim 15, wherein the cylindrical cross section of the blades of the first and second swirl device has the shape of an airfoil.

22. The burner arrangement as claimed in claim 21, wherein each of the blades of the first and second swirl device has a leading edge and a trailing edge, whereby the leading edge of the blades of the second swirl device is aligned in terms of inflow angle with outflow angle of the trailing edge of the blades of the first swirl device.

23. The burner arrangement as claimed in claim 21, wherein said airfoils of said swirl devices are designed to produce a certain exit flow angle $\alpha$ of the air/fuel flow, whereby said exit flow angle $\alpha$ has a predetermined dependence $\alpha(r)$ of the radius r with respect to the burner axis.

24. The burner arrangement as claimed in claim 23, wherein $\tan \alpha(r) = H \cdot r + K$ with constants H and K.

25. The burner arrangement as claimed in claim 23, wherein $\tan \alpha(r)$ is proportional to 1/r.

26. The burner arrangement as claimed in claim 23, wherein $\tan \alpha(r) = \text{const}$.

27. The burner arrangement as claimed in claim 15, wherein the air tube is cylindrical in shape having an inner air tube radius, that a concentric central bluff body is arranged within said air tube having an outer bluff body radius, and that the ratio between said outer bluff body radius and said inner air tube radius is between 0.3 and 0.8.

28. The burner arrangement as claimed in claim 17, wherein the fuel is supplied to the blades of the first and second swirl device via respective cavities within said blades by means of a fuel distribution system, which allows to control the fuel supply to each swirl device of the first and second swirl devices, each blade of the first and second swirl devices, and each of said suction and pressure sides of each blade of the first and second swirl devices.

29. The burner arrangement as claimed in claim 23, wherein said first and second swirl devices have an outer radius R and said first mixing zone has an axial length L, and said ratio L/R is between 0.5 and 4.

* * * * *